US010358248B2

(12) United States Patent
Donohoo et al.

(10) Patent No.: US 10,358,248 B2
(45) Date of Patent: Jul. 23, 2019

(54) METHOD OF CONVERTING AN EXISTING FLEXIBLE INTERMEDIATE BULK CONTAINER OR BULK BAG UNLOADER TO A CONTINUOUS FEED BULK CARGO RECEIVER

(71) Applicant: Apex Business Holdings, L.P., Calvert City, KY (US)

(72) Inventors: Mark K. Donohoo, Calvert City, KY (US); Michael L. Walker, Paducah, KY (US); Michael A. Meredith, Paducah, KY (US); Steven W. Spahn, Evansville, IN (US); Jeffrey H. West, Newburgh, IN (US)

(73) Assignee: Apex Business Holdings, L.P., Calvert City, KY (US)

( * ) Notice: Subject to any disclaimer, the term of this patent is extended or adjusted under 35 U.S.C. 154(b) by 417 days.

(21) Appl. No.: 14/757,699

(22) Filed: Dec. 23, 2015

(65) Prior Publication Data

US 2017/0183172 A1 Jun. 29, 2017

(51) Int. Cl.
*B65B 69/00* (2006.01)

(52) U.S. Cl.
CPC ..... *B65B 69/0083* (2013.01)

(58) Field of Classification Search
CPC . B65G 65/42; B65B 69/0083; B65B 69/0075; B65B 69/0091; B65D 88/165; B65D 88/1681; B65D 88/1618; B65D 88/1688; B65D 88/1631; B65D 88/26
See application file for complete search history.

(56) References Cited

U.S. PATENT DOCUMENTS

| | | | | |
|---|---|---|---|---|
| 6,340,100 | B1 * | 1/2002 | Gill | B65B 69/0075 141/315 |
| 9,387,950 | B2 * | 7/2016 | Hofman | B65B 69/0091 |
| 2011/0056964 | A1 * | 3/2011 | Ambriz | B65D 88/26 220/601 |

* cited by examiner

*Primary Examiner* — David P Bryant
*Assistant Examiner* — Lee A Holly
(74) *Attorney, Agent, or Firm* — Joseph M. Rolnicki; Evans & Dixon, L.L.C.

(57) ABSTRACT

A converter converts an existing bulk bag unloader to a bulk cargo receiver that eliminates the use of bulk bags. The converter enables the unloader to receive a continuous feed of bulk cargo without any interruptions such as those needed to unload emptied bulk bags and reload the unloader with full bulk bags.

19 Claims, 5 Drawing Sheets

METHOD OF CONVERTING AN EXISTING FLEXIBLE INTERMEDIATE BULK CONTAINER OR BULK BAG UNLOADER TO A CONTINUOUS FEED BULK CARGO RECEIVER

FIELD

The field of this disclosure is flexible intermediate bulk container or bulk bag unloaders. In particular, the field of this disclosure is a method of converting an existing bulk bag unloader to a bulk cargo receiver that eliminates the use of bulk bags.

BACKGROUND

A flexible intermediate bulk container (FIBC) or a bulk bag is a large container of flexible fabric that is used to store and transport heavy loads of flowable products such as seeds, nuts, sand, fertilizer and granules or pellets of plastic. The bags are constructed with woven polypropylene or other equivalent fabrics, and often have a large opening at their top and a spout that can be closed at their bottom. A typical bulk bag can be dimensioned to hold approximately 50 cubic feet of bulk cargo. A typical bulk bag is constructed with four heavy duty strap loops that are positioned at four corners of the bag around the top opening of the bag. A bulk bag filled with bulk cargo can be lifted and transported by a forklift with the forks of the forklift each passing through pairs of adjacent strap loops of the four strap loops. A bulk bag filled with bulk cargo can also be transported by being positioned on a pallet that is lifted by a forklift.

The bulk cargo transported in a bulk bag is unloaded from the bulk bag by a bulk bag unloader. FIG. 1 is a representation of a typical unloader 10. The unloader 10 has a rigid, stationary framework 12 supporting the component parts of the unloader 10. A hopper 14 is supported by the framework 12 at a bottom of the unloader. A rail 16 is supported by the framework 12 at a top of the unloader. The rail 16 extends over the top of the hopper 14 and over an area adjacent the hopper 14.

A trolly 22 having a hoist 24 is provided on the rail 16. The trolly 22 is moveable on the rail 16 from one end of the rail 16 where the hoist 24 is positioned adjacent the hopper 14 to an opposite end of the rail 16 where the hoist 24 is positioned above the hopper 14.

A cable 26 extends downwardly from the hoist 24. The bottom of the cable 26 is connected to an X-shaped lifting member 28. The lifting member 28 has four arms 32 with hooks 34 at the distal ends of the arms.

A conveyor 36 is positioned beneath the hopper 14. The conveyor 36 receives bulk cargo dispensed from the hopper 14 and conveys the bulk cargo away from the unloader 10.

In operation of the bulk bag unloader 10, a bulk bag 38 containing bulk cargo is first positioned adjacent the hopper 14 of the unloader 10. The hoist 24 is then operated to lower the X-shaped lifting member 28. The lifting member 28 is lowered a sufficient distance to enable the four strap loops on the bulk bag 38 to be engaged in the four hooks 34 of the lifting member 28. Engaging the four strap loops 40 of the bulk bag 38 in the four hooks 34 attaches the bulk bag to the lifting member 28 of the bulk bag unloader 10.

The hoist 24 is then operated to retract the cable 26 and lift the bulk bag 38 suspended by its four strap loops 40 from the lifting member 28. The bulk bag 38 is raised a sufficient distance to position the bulk bag above the top of the hopper 14. The trolley 22 is then operated to move the lifted bulk bag 38 from its position adjacent the hopper 14 to a position of the bulk bag 38 over the hopper 14.

With the bulk bag 38 positioned over the hopper 14, the spout at the bottom of the bulk bag can then be opened. Opening the spout allows the bulk cargo contained in the bulk bag 38 to pour from the spout and into the top of the hopper 14. When all of the bulk cargo has exited the bulk bag 38 into the hopper 14, the trolley 22 is then operated to move the emptied bulk bag 38 from its position over the hopper 14 to a position adjacent the hopper 14. The hoist 24 is then operated to lower the emptied bulk bag 38 a sufficient distance to enable the strap loops 40 of the emptied bulk bag 38 to be removed from the four hooks 34 of the lifting member 28. The process of attaching a bulk bag 38 containing bulk cargo to the lifting member 28, and then moving the bulk bag 38 containing bulk cargo to a position over the hopper 14 where the bulk bag 38 can be emptied is repeated.

It can be appreciated that the above described repeated sequences of unloading bulk cargo from bulk bags to a hopper is significantly time consuming.

There are existing continuous bulk cargo unloaders that use vacuum pressure to draw a stream of bulk cargo to a hopper which then dispenses the bulk cargo to a conveyor. However, removing an existing bulk bag unloader from its location and replacing it with a new continuous bulk cargo unloader can be very expensive.

SUMMARY

The method of this disclosure that converts an existing bulk bag unloader to a bulk cargo receiver overcomes the disadvantage of the significant time required to repeatedly unload bulk cargo from bulk bags to a hopper. The method basically replaces the bulk bags that are unloaded by a bulk bag unloader such as that described earlier. Additionally, the method does not require that the existing bulk bag unloader be entirely replaced, but makes use of the existing unloader. This significantly reduces the cost of the conversion.

The method involves assembling a converter to an existing bulk bag unloader. The converter includes a rigid tank that is attached to the framework of the existing unloader and is supported by the framework of the unloader. The tank has at least one side wall that extends around an interior volume of the tank. The tank has a top opening at a top end of the at least one side wall of the tank and a bottom opening at a bottom end of the at least one side wall of the tank. The tank is suspended by the lifting member and hoist of the existing unloader over the hopper of the existing unloader. The interior volume of the tank is communicated through the bottom opening of the tank with the interior volume of the hopper through the top opening of the hopper.

A tube is attached to the tank. The tube has a length with opposite proximal and distal ends and an interior bore that extends through the length of the tube. The proximal end of the tube is connected to the tank. A proximal end opening of the tube communicates the interior bore of the tube with the top opening of the tank and the interior volume of the tank. The distal end of the tube is configured for communication with bulk cargo. A distal end opening of the tube communicates the bulk cargo with the interior bore of the tube. The bulk cargo could be contained in a silo, a rail car, day bins, box tippers, drums or other equivalent means of containing bulk cargo.

A vacuum source is connected to the tank and communicates with the interior volume of the tank. The vacuum source is operable to create a vacuum pressure in the interior volume of the tank. The vacuum pressure is communicated to the interior bore of the tube and to the distal end of the tube where the distal end opening of the tube is communicated with the bulk cargo. The vacuum pressure draws the bulk cargo through the distal end opening of the tube, through the interior bore of the tube, through the proximal end opening of the tube, through the top opening of the tank and into the interior volume of the tank. The bulk cargo in the interior volume of the tank is fed or dropped by gravity through the bottom opening of the tank, through the top opening of the hopper and into the interior volume of the hopper. From the interior volume of the hopper, the bulk cargo drops through the bottom opening of the hopper to the conveyor below the bottom opening of the hopper.

BRIEF DESCRIPTION OF THE DRAWINGS

Further features of the method of converting an existing bulk bag unloader to a bulk cargo receiver are set forth in the following detailed description of the method and the drawing figures.

DESCRIPTION

Figure 1:
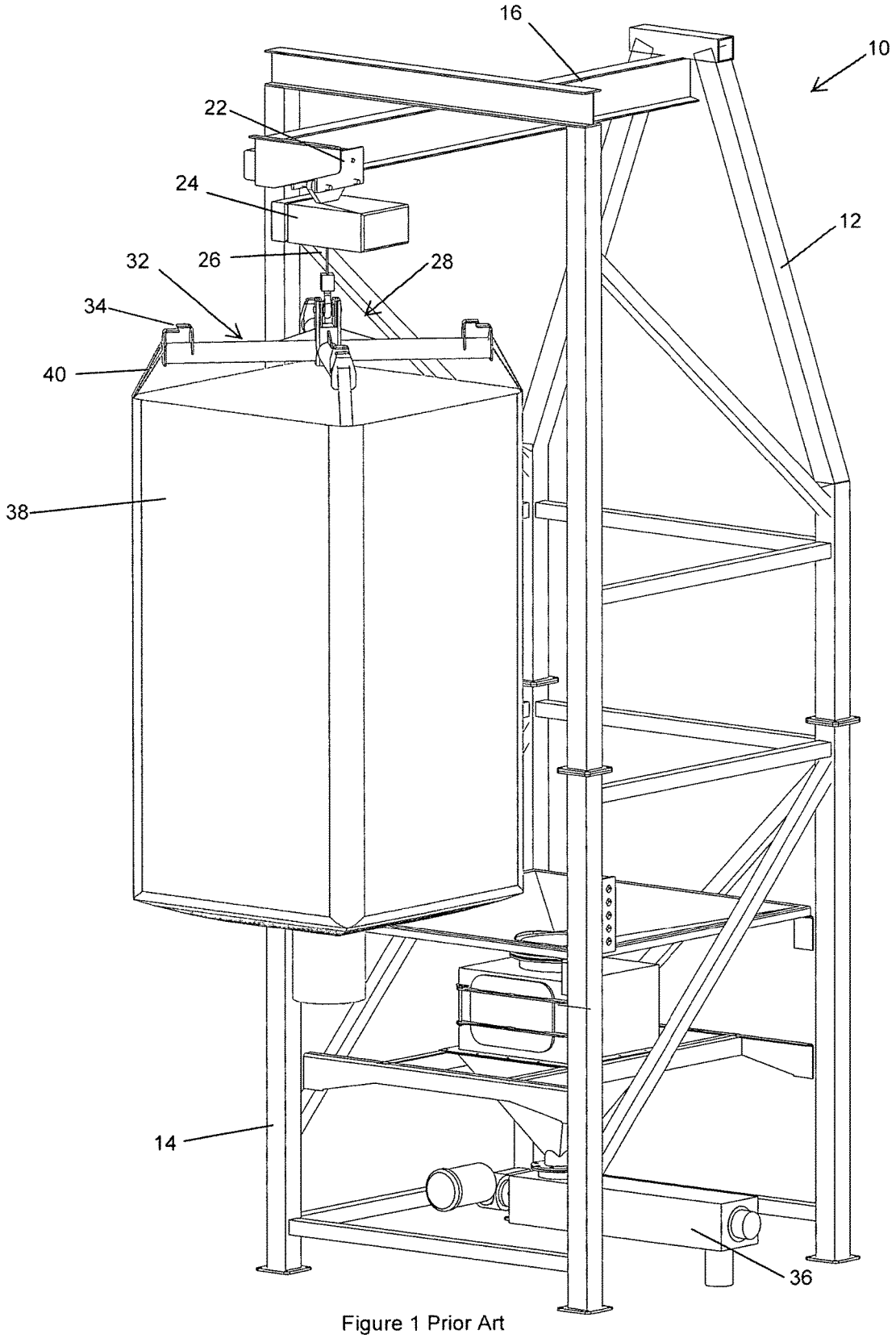
Figure 1 Prior Art
FIG. 1 is a representation of the construction of a typical bulk bag unloader.
Figure 3:
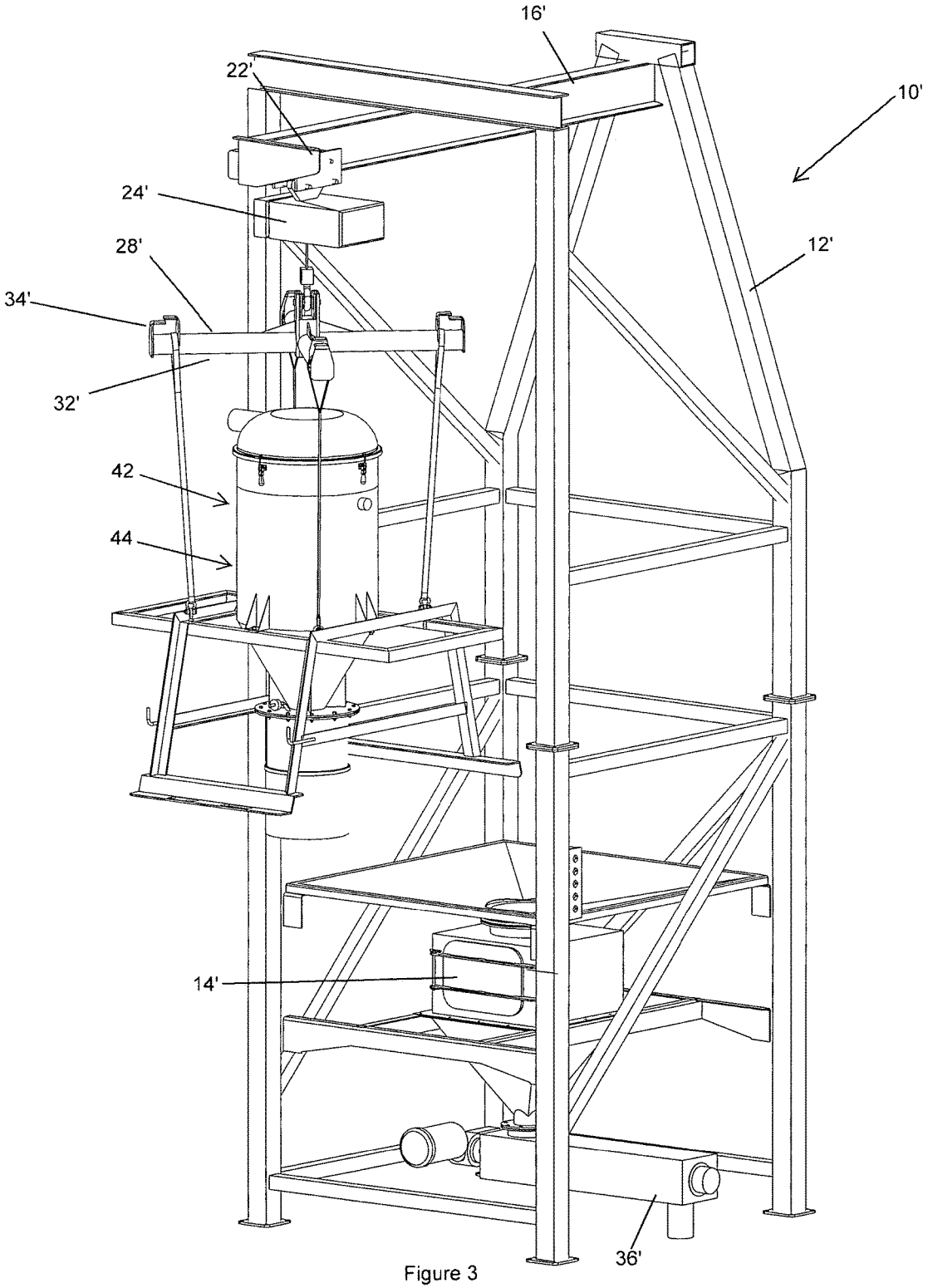
FIG. 3 is a representation of the existing bulk bag unloader of FIG. 1 with the converter of this disclosure being assembled to the bulk bag unloader.
Figure 4:
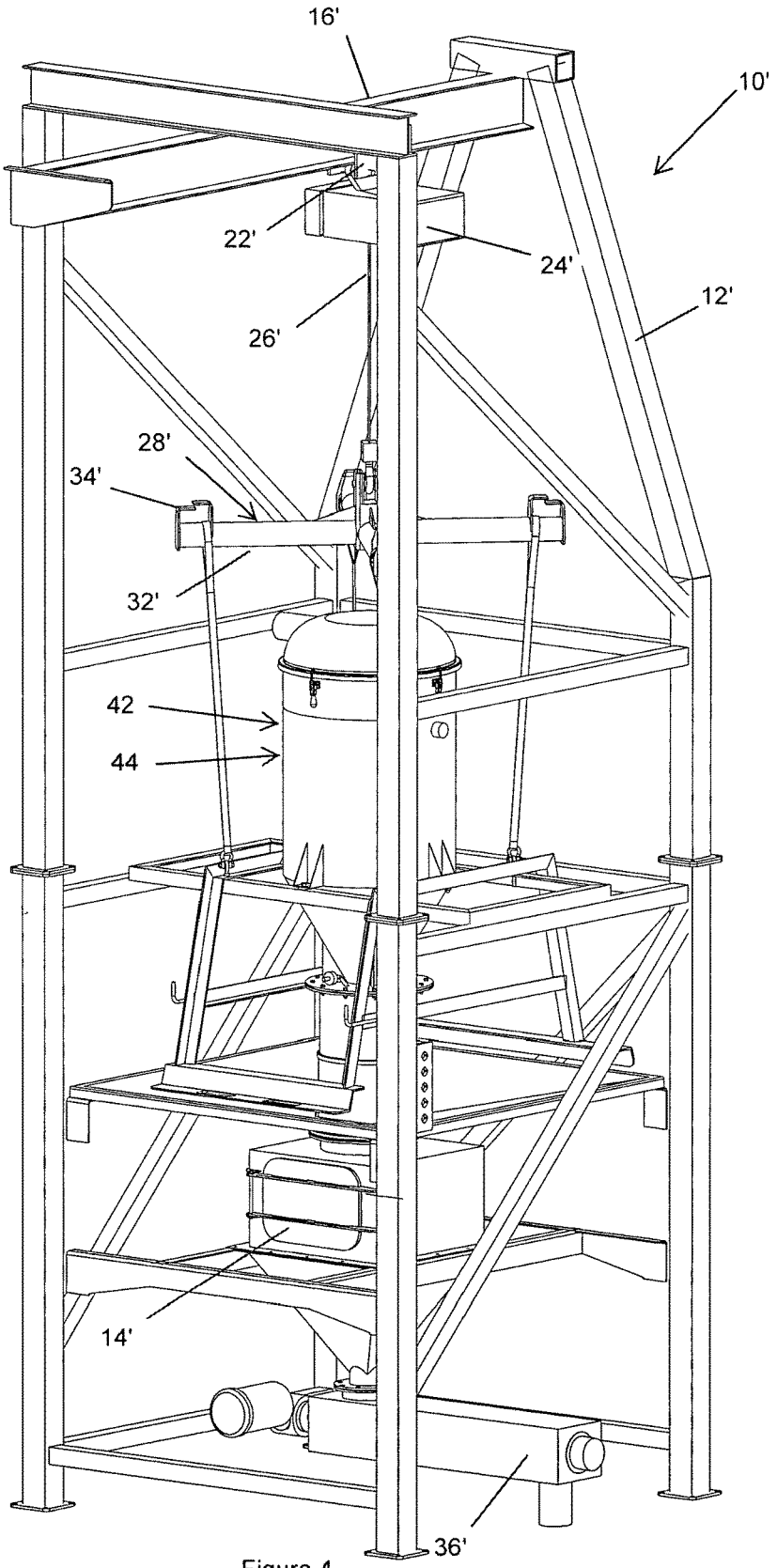
FIG. 4 is a representation of the existing bulk bag unloader that has been modified with the converter of this disclosure.

Referring to FIGS. 3 and 4, the method of converting an existing bulk bag unloader 10' to a bulk cargo receiver using the converter 42 of this disclosure is shown. The existing bulk bag unloader 10' has the same construction as the bulk bag unloader 10 described earlier and therefore will not again be described in detail. The component parts of the bulk bag unloader 10' shown in FIGS. 3 and 4 are labeled with the same reference numbers used in describing the construction of the bulk bag unloader 10 of FIG. 1, with the reference numbers being followed by a prime (').

Figure 2:
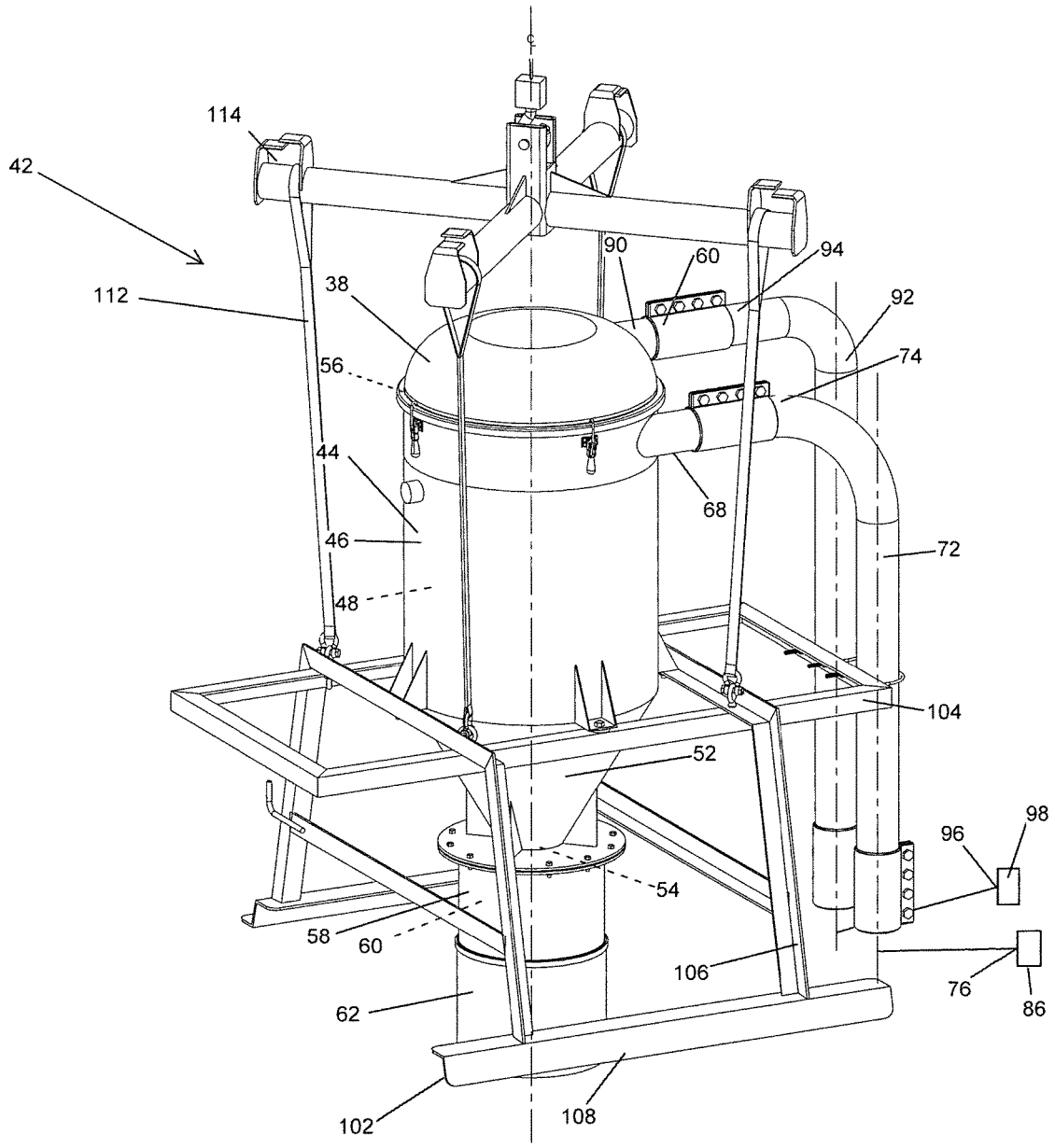
FIG. 2 is a representation of a perspective view of the method of converting the existing bulk bag unloader to a bulk cargo receiver using the converter of this disclosure.

FIG. 2 shows a representation of the converter 42 used in the method of this disclosure. As stated earlier, the converter 42 basically replaces the bulk bags that are unloaded by a bulk bag unloader. The converter 42 enables a continuous feed or flow of bulk cargo to the converter 42. That continuous flow of bulk cargo is then delivered by the converter 42 to the hopper of the existing bulk bag unloader 10'. This method does not require that the existing unloader be entirely replaced with a continuous bulk cargo receiver, but makes use of the existing bulk bag unloader. This significantly reduces the cost of the conversion.

The converter 42 includes a tank 44. The tank 44 is constructed of rigid material, for example steel or stainless steel. Other equivalent materials could be employed in constructing the tank 44. The tank 44 has at least one side wall 46 that extends around a hollow interior volume 48 of the tank. The side wall 46 gives the tank 44 a general cylindrical configuration. However, the tank 44 could be constructed with other equivalent configurations. The at least one side wall 46 of the tank 44 has a lower portion 52 having a general conical shape. The tank lower portion 52 tapers as it extends downwardly to a circular bottom opening 54 at a bottom end of the at least one side wall 46. The tank has a circular top opening 56 at the top end of the at least one side wall 46 of the tank.

An outlet pipe 58 is attached to the bottom of the tank 44. The outlet pipe 58 has a cylindrical configuration and a hollow interior bore 60 that communicates with the interior volume 48 of the tank 44 through the bottom opening 54 of the tank 44. The outlet pipe 58 has a flexible portion 62 at a bottom end of the outlet pipe.

An inlet tube 68 is connected to the at least one side wall 46 of the tank 44. As represented in FIG. 2, the inlet tube 68 is connected to the at least one side wall 46 adjacent the top opening 56 of the tank 44 and at an orientation that is generally tangent to the at least one side wall.

A supply tube 72 is connected to the inlet tube 68. The supply tube 72 has a length with opposite proximal 74 and distal 76 ends and an interior bore that extends through the length of the tube. The supply tube proximal end 74 is connected to the inlet tube 68 of the tank 44. The supply tube proximal end 74 has a proximal end opening that communicates through the inlet tube 68 with the interior volume 48 of the tank 44. The distal end 76 of the supply tube 72 has a distal end opening. The distal end opening of the supply tube 72 is configured for communication with bulk cargo 86. The distal end 76 of the supply tube 72 has a flexible portion that facilitates communication with the bulk cargo 86. The bulk cargo 86 is represented schematically in FIG. 2. The bulk cargo 86 could be contained in a storage silo, in a rail car, in day bins, and box tippers, in drums or other equivalent means of containing, storing and transporting bulk cargo.

A domed shaped cover 88 is attached over the top opening 56 of the tank 44. The cover 88 is secured to the top end of the at least one side wall 46 of the tank 44. The domed shape of the cover 88 encloses the interior volume 48 of the tank 44. The cover 88 could have another equivalent configuration to the dome shape represented in the drawing figures.

An outlet tube 90 is connected to the cover 88. As represented in FIG. 2, the outlet tube 90 is connected to the domed shaped cover 88 adjacent a peripheral edge of the cover 88 and at an orientation that is directed toward the center of the domed shaped cover 88 and the center of the tank 44.

A vacuum tube 92 is connected to the outlet tube 90 of the dome shaped cover 88. The vacuum tube 92 has a length with opposite proximal 94 and distal 96 ends and an interior bore that extends through the length of the tube. The vacuum tube proximal end 94 is connected to the outlet tube 90 of the domed shape cover 88. The vacuum tube proximal end 94 has a proximal end opening that communicates through the outlet tube 90 with the interior volume 48 of the tank 44. The distal end 96 of the vacuum tube 92 is configured for communication with a vacuum source 98. The vacuum source 98 is represented schematically in FIG. 2. The vacuum source 98 could be any type of vacuum source, for example a regenerative vacuum blower. The vacuum source 98 communicates through the vacuum tube 92 with the interior volume 48 of the tank 44.

A support structure 102 is attached to the tank 44. The support structure 102 is constructed of metal angled pieces or other equivalent types of materials. As represented in FIG. 2, the support structure 102 has a plurality of horizontal members 104 that extend around the tank 44. Additionally, the support structure 102 has a plurality of legs 106 that extend downwardly from the horizontal members 104 to a pair of unloader engaging members 108 at opposite bottom ends of the support structure 102. The unloader engaging members 108 are configured for engaging with portions of a bulk bag unloader 10' in assembling the converter 42 to the existing bulk bag unloader according to the method of this disclosure and supporting the tank 44 over the hopper 14' of the unloader 10'.

According to the method of this disclosure, four slings 112 are attached to four corners of the support structure 102 of the converter as represented in FIG. 2. The slings could be constructed as steel chains or other equivalent materials. The four slings 112 extend upwardly to four lifting rings 114 formed at the top ends of the slings. The lifting rings 114 are dimensioned to fit over the arms 32' and into the hooks 34' of the lifting member 28' of the existing unloader 10'.

Figure 5:
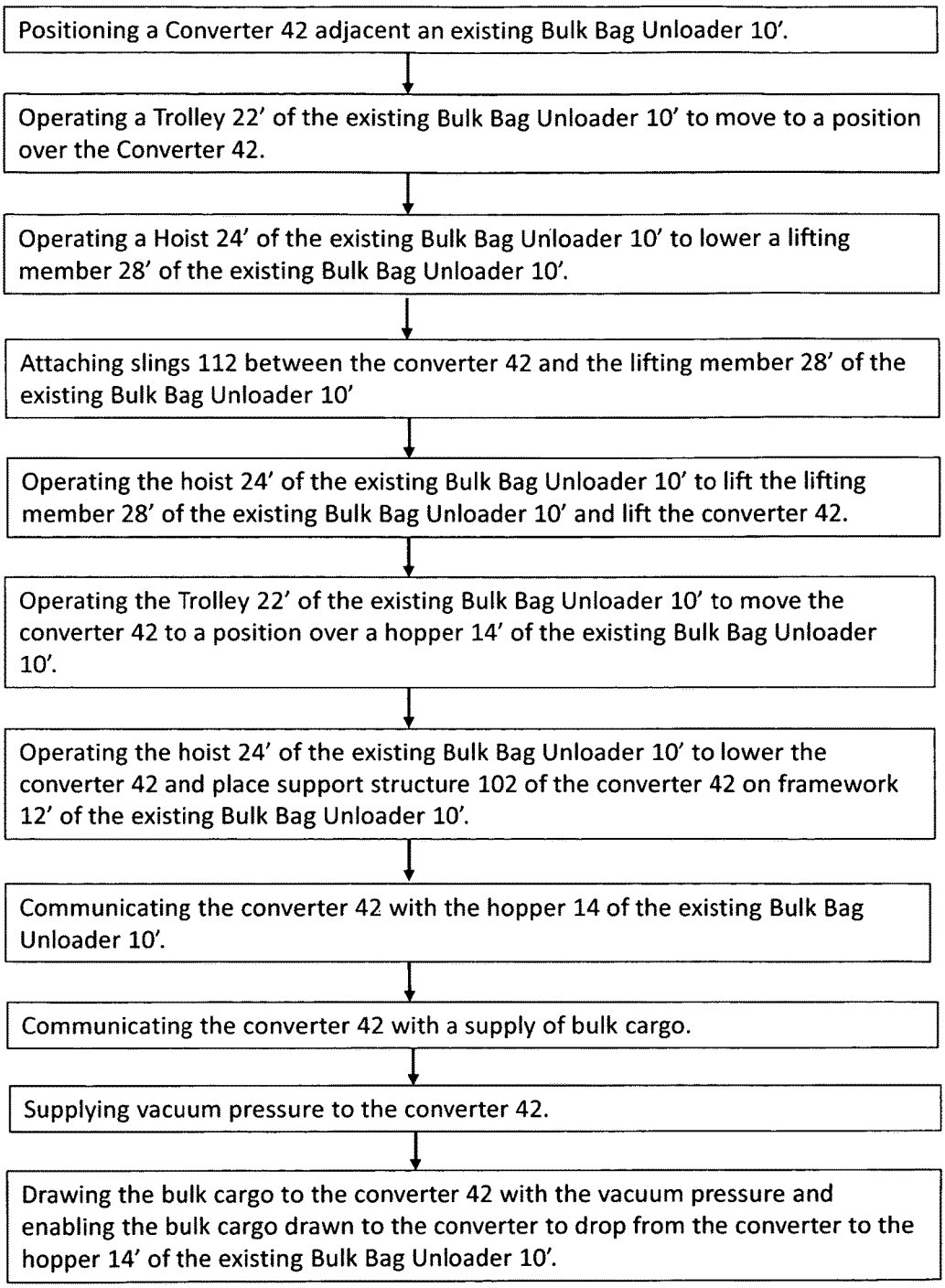
FIG. 5 is a representation of a flow chart of the method of this disclosure.

FIGS. 3 and 4 are representations of the converter 42 being assembled to an unloader 10' according to the method of this disclosure. Basically, the converter 42 is assembled to the unloader 10' in much the same manner as the bulk bag 38 is assembled to the unloader 10 represented in FIG. 1. In the first step of the method of converting an existing bulk bag unloader a continuous bulk cargo receiver, the converter 42 is first positioned adjacent the hopper 14' of the unloader 10'. This is represented in the first step 120 of FIG. 5. The trolley 22' is then operated to move along the rail 16' to a position over the converter 42. This is represented in step 122 of FIG. 5. The hoist 24' is then operated to lower the X-shaped lifting member 28'. The lifting member 28' is lowered a sufficient distance to enable the four slings 112 of the converter 42 to be manually extended upwardly to reach the arms 32' of the lifting member 28'. This is represented in the step 124 of FIG. 5. The lifting rings 114 at the distal ends of the four slings 112 are then positioned over the arms 32' of the lifting member 28' and are engaged with the hooks 34' at the ends of the arms. Engaging the lifting rings 114 in the hooks 34' attaches the converter 42 to the lifting member 28' of the unloader 10'. This is represented in step 126 of FIG. 5.

The hoist 24' is then operated to retract the cable 26' and lift the converter 42 suspended by the four slings 112 from the existing lifting member 28'. This is represented in FIG. 3 and in step 128 of FIG. 5. The converter 42 is raised a sufficient distance to position the converter above the top of the hopper 14' of the unloader 10'. The trolley 22' is then operated to move the raised converter 42 from its position adjacent the hopper 14' to a position of the converter 42 over the hopper 14'. This is represented in step 132 of FIG. 5.

With the converter 42 positioned over the hopper 14', the hoist 24' is then operated to lower the converter 42. The lowering of the converter 42 continues until the unloader engaging members 108 of the support structure 102 of the converter 42 engage on top of portions of the framework 12' of the unloader 10'. This is represented in FIG. 4 and in step 134 of FIG. 5. At this point, the framework 12' of the unloader 10' is supporting the converter 42 in a position above the hopper 14'.

The flexible portion 42 of the outlet pipe 58 of the converter 42 is then communicated with a top opening of the hopper 14'. This is represented in step 136 of FIG. 5. This completes the method of converting the existing bulk bag unloader 10' to a continuous bulk bag receiver.

The distal end 76 of the supply tube 72 is then communicated with the bulk cargo 86. This is represented in step 138 of FIG. 5.

The vacuum source 98 is then operated to create a vacuum pressure in the interior volume 48 of the tank 44. This is represented in step 142 of FIG. 5. The vacuum pressure is communicated from the interior volume 48 of the tank 44, through the inlet tube 68, through the proximal end 74 of the supply tube, through the interior bore of the supply tube and to the distal end 76 of the supply tube.

The vacuum pressure at the supply tube distal ends 76 draws the bulk cargo 86 through the distal end 76 of the supply tube, through the interior bore of the supply tube, through the proximal end 74 of the supply tube, through the inlet tube 68 attached to the tank 44 and into the interior volume 48 of the tank. The bulk cargo drawn into the interior volume 48 of the tank is fed or dropped by gravity through the bottom opening 54 of the tank 44, through the outlet pipe 58, through the top opening of the hopper 14' and into the interior volume of the hopper. This is represented in step 144 of FIG. 5. From the interior volume of the hopper 14', the bulk cargo drops from the hopper to the conveyor 36' below the bottom of the hopper. The conveyor 36' then conveys the bulk cargo away from the unloader 10'.

In the above manner, the conversion of the existing bulk bag unloader 10' according to the method of the disclosure enables a continuous flow of bulk cargo 86 to the hopper 14' without any interruptions such as those needed to replace an emptied bulk bag.

As various modifications could be made in the method herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

What is claimed:

1. A method of converting an existing bulk bag unloader to a continuous feed bulk cargo receiver, the method comprising:

replacing bulk bags of the existing bulk bag unloader with a tank;

positioning the tank on a framework of the existing unloader and supporting the tank by the framework, the tank having an interior volume, the tank having a top opening at a top of the tank, the tank having a bottom opening at a bottom of the tank; supporting the tank over a hopper and communicating with the interior volume of the tank with an interior volume of the hopper through the bottom opening of the tank and through a top opening of the hopper;

attaching a support structure to the tank, the support structure extending downwardly from the tank to bottom ends of the support structure positioned below the bottom opening of the tank;

engaging the bottom ends of the support structure with the framework of the existing unloader in assembling the tank and the support structure to the existing unloader and attaching the tank to the framework of the existing unloader, and supporting the tank on the framework with the bottom opening of the tank above the top opening of the hopper;

communicating a supply tube with the top opening of the tank and the interior volume of the tank by attaching the supply tube to the tank, configuring a distal end opening of the supply tube for communication with a bulk cargo through the distal end opening of the supply tube; and, communicating a vacuum source with the interior volume of the tank, the vacuum source being operable to create a vacuum pressure in the interior volume of the tank and at the distal end opening of the supply tube where when the distal end opening of the supply tube is communicated with a bulk cargo the vacuum pressure draws the bulk cargo through the distal end opening of the supply tube, through the supply tube, through the top opening of the tank and into the interior volume of the tank where the bulk cargo in the interior volume of the tank can drop through the bottom opening of the tank, through the top opening of the hopper and into the interior volume of the hopper.

2. The method of claim 1, further comprising:

constructing the tank to be rigid.

3. The method of claim 2, further comprising:

the existing unloader having a bulk container pick up device attached to the framework and supported by the framework, attaching the tank to the bulk container pick up device and suspending the tank over the hopper.

4. The method of claim 3, further comprising:

the existing unloader having a rail attached to the framework;

the bulk container pick up device being mounted on the rail for movement of the bulk container pick up device between first and second positions relative to the rail where in the first position the bulk container pick up device is displaced from over the hopper and in the second position the bulk container pick up device is positioned over the hopper; and, attaching the tank to the bulk container pick up device at the first position of the bulk container pick up device then moving the bulk container pick up device to the second position.

5. The method of claim 2, further comprising:

constructing at least a portion of the supply tube to be flexible.

6. The method of claim 2, further comprising:

providing a flexible hose on the bottom of the tank.

7. The method of claim 1, further comprising:

attaching a plurality of slings on the support structure, attaching the plurality of slings to the bulk container pick up device.

8. The method of claim 1, further comprising:

attaching an outlet pipe to the tank.

9. A method of converting an existing bulk bag unloader to a continuous feed bulk cargo receiver, the method comprising:

replacing bulk bags of the existing bulk bag unloader with a tank;

positioning the tank over a hopper of the existing bulk bag unloader, the tank having an interior volume, a top opening at a top of the tank and a bottom opening at a bottom of the tank;

attaching a support structure to the tank with the support structure extending downwardly from the tank to bottom ends of the support structure positioned below the bottom opening of the tank;

engaging the bottom ends of the support structure with a framework of the existing unloader in assembling the tank and the support structure to the existing unloader and attaching the tank to the framework of the existing unloader, and supporting the tank on the framework;

communicating the interior volume of the tank with an interior volume of the hopper through the bottom opening of the tank and through a top opening of the hopper;

communicating a supply tube with the interior volume of the tank by attaching the supply tube to the tank, the supply tube having a length with opposite proximal and distal ends and an interior bore extending through the length of the supply tube, the proximal end of the supply tube having a proximal end opening, the proximal end opening of the supply tube communicating the interior bore of the supply tube with the top opening of the tank and the interior volume of the tank, the distal end of the supply tube having a distal end opening, configuring the distal end opening of the supply tube for communicating with a bulk cargo through the distal end opening of the supply tube; and, communicating a vacuum source with the interior volume of the tank, the vacuum source being operable to create a vacuum pressure in the interior volume of the tank, in the interior bore of the supply tube and at the distal end opening of the supply tube where when the distal end of the supply tube is communicated with a bulk cargo, the vacuum pressure draws the bulk cargo through the distal end opening of the supply tube, through the interior bore of the supply tube, through the proximal end opening of the supply tube, through the top opening of the tank and into the interior volume of the tank where the bulk cargo in the interior volume of the tank can drop through the interior volume of the tank, through the bottom opening of the tank, through the top opening of the hopper and into the interior volume of the hopper.

10. The method of claim 9, further comprising:

providing the tank with a rigid construction.

11. The method of claim 10, further comprising:

providing at least a portion of the supply tube with a flexible construction.

12. The method of claim 9, further comprising:

the existing unloader having a bulk container pick up device attached to the framework and supported by the framework, and, attaching the tank to the bulk container pick up device with the bulk container pick up device suspending the tank above the hopper.

13. The method of claim 12, further comprising:

the existing unloader having a rail attached to the frame;

the bulk container pick up device being mounted on the rail for movement of the bulk container pick up device between first and second positions relative to the rail where in the first position the bulk container pick up device is outside the framework and displaced from over the hopper and in the second position the bulk container pick up device is positioned inside the framework and over the hopper; and, attaching the tank to the bulk container pick up device when the bulk container pick up device is in the first position where in the first position the tank is outside the framework and moving the bulk container pick up device to the second position where in the second position the tank is inside the framework.

14. The method of claim 9, further comprising:

attaching a flexible hose on the bottom of the tank, the flexible hose communicating the bottom opening of the tank with the top opening of the hopper.

15. The method of claim 9, further comprising:

attaching a plurality of slings on the support structure, attaching the plurality of slings to the bulk container pick up device.

16. The method of claim 9, further comprising:

attaching an outlet pipe to the tank.

17. A method of converting an existing bulk bag unloader to a continuous feed bulk cargo receiver, the method comprising:

replacing bulk bags of the existing bulk bag unloader with a rigid tank;

positioning the rigid tank over a hopper of the existing bulk bag unloader;

attaching a support structure to the rigid tank with the support structure extending downwardly from the rigid tank to bottom ends of the support structure positioned below the rigid tank;

engaging the bottom ends of the support structure with a framework of the existing bulk bag unloader in assembling the rigid tank and the support structure to the existing bulk bag unloader and attaching the rigid tank to the framework of the existing bulk bag unloader, and supporting the rigid tank on the framework of the existing bulk bag unloader;

communicating an interior volume of the rigid tank with an interior volume of the hopper;

attaching a supply tube to the rigid tank;

communicating the interior volume of the rigid tank with bulk cargo through the supply tube; and, supplying vacuum pressure to the interior volume of the rigid tank and drawing the bulk cargo into the interior volume of the rigid tank with the vacuum pressure, where bulk cargo in the interior volume of the rigid tank drops from the rigid tank and into the interior volume of the hopper.

18. The method of claim 17, further comprising:

positioning the rigid tank above the hopper of the bulk bag unloader by suspending the rigid tank from a bulk container pick up device of the existing bulk bag unloader.

19. The method of claim 17, further comprising:

attaching an outlet pipe to the rigid tank.

* * * * *